US006205632B1

(12) United States Patent
Weeks et al.

(10) Patent No.: US 6,205,632 B1
(45) Date of Patent: Mar. 27, 2001

(54) BOILER TUBE FLARED-END COMPRESSION TOOL

(75) Inventors: Bruce V. Weeks, Pataskala; Richard Arthur, New Albany; Robert L. Richards, Dublin, all of OH (US)

(73) Assignee: Advanced Cutting Technologies, Ltd., Westerville, OH (US)

( * ) Notice: Subject to any disclaimer, the term of this patent is extended or adjusted under 35 U.S.C. 154(b) by 0 days.

(21) Appl. No.: 09/415,749

(22) Filed: Oct. 12, 1999

(51) Int. Cl.[7] ..... B23P 15/26

(52) U.S. Cl. ..... 29/33 T; 29/727; 29/726; 29/890.031

(58) Field of Search ..... 29/870.031, 726, 29/727, 33 R, 723, 402.08, 33 T, 426.5, 252; 279/35; 72/452.9, 402

(56) References Cited

U.S. PATENT DOCUMENTS 3,835,520 * 9/1974 Sismore ..... 29/726
3,857,158 * 12/1974 Costello ..... 29/890.031
4,967,468 * 11/1990 Vossbrinck et al. ..... 29/726
5,205,038 * 4/1993 Archer et al. ..... 29/890.031
5,826,334 * 10/1998 Weeks et al. ..... 29/890.031
5,826,335 * 10/1998 Tegethoff et al. ..... 29/890.031
5,974,642 * 11/1999 Weeks et al. ..... 29/33 T

* cited by examiner

*Primary Examiner*—S. Thomas Hughes
*Assistant Examiner*—Trinh Nguyen
(74) *Attorney, Agent, or Firm*—Thomas S. Baker, Jr.

(57) ABSTRACT

A compression tool assembly that is useful in connection with the removal of boiler tube flared-end segments from retention within power boiler header walls is provided with oppositely paired compression jaw elements that are rotated to cause the wall of a longitudinally gapped boiler tube flared-end segment to be compressed into a cross-section configuration that permits comparatively easy tube segment withdrawal.

8 Claims, 7 Drawing Sheets

BOILER TUBE FLARED-END COMPRESSION TOOL

CROSS-REFERENCES

None.

FIELD OF THE INVENTION

This invention pertains generally to power boilers, and specifically concerns apparatus that is particularly useful in connection with the removal of selected installed boiler tubes for subsequent replacement.

BACKGROUND OF THE INVENTION

The removal of water-tubes and fire-tubes from within power boilers for subsequent replacement using a tube-end gap-cutting tool of the type disclosed and claimed in U.S. Pat. No. 5,893,209 granted to Weeks et al. results in an installed boiler tube flared-end segment that although having a longitudinal gap is still retained in the co-operating boiler drum wall. I have discovered that removal of the retained and gapped boiler tube flared-end segment is facilitated if the segment is first properly diametrically compressed prior to longitudinal withdrawal from the co-operating boiler drum or header wall.

Other objects and advantages of the present invention will become apparent from a consideration of the descriptions, drawings, and claims which follow.

SUMMARY OF THE INVENTION

The present invention is basically comprised of a tool head subassembly provided with a rigid frame, with multiple, tubed-end segment rotatable compression jaws carried by the rigid frame for engagement with a boiler tube flared-end, and with a reciprocating cam element that causes pivoting of the tool assembly compression jaws, and of a reversible, pressurized fluid actuator subassembly that is supported by the tool head frame and that causes reciprocating movement of the tool head cam element. Operation of the actuator subassembly in a positive direction, following proper initial engagement of the tool head compression jaws with a cut boiler tube flared-end segment causes the wall of the boiler tube segment to be compressed and "curled" diametrically. The tool may then be conveniently removed from engagement with the boiler tube end segment by simple longitudinal rotation, and the reciprocating cam retracted in preparation for next use of the tool.

Figure 1:
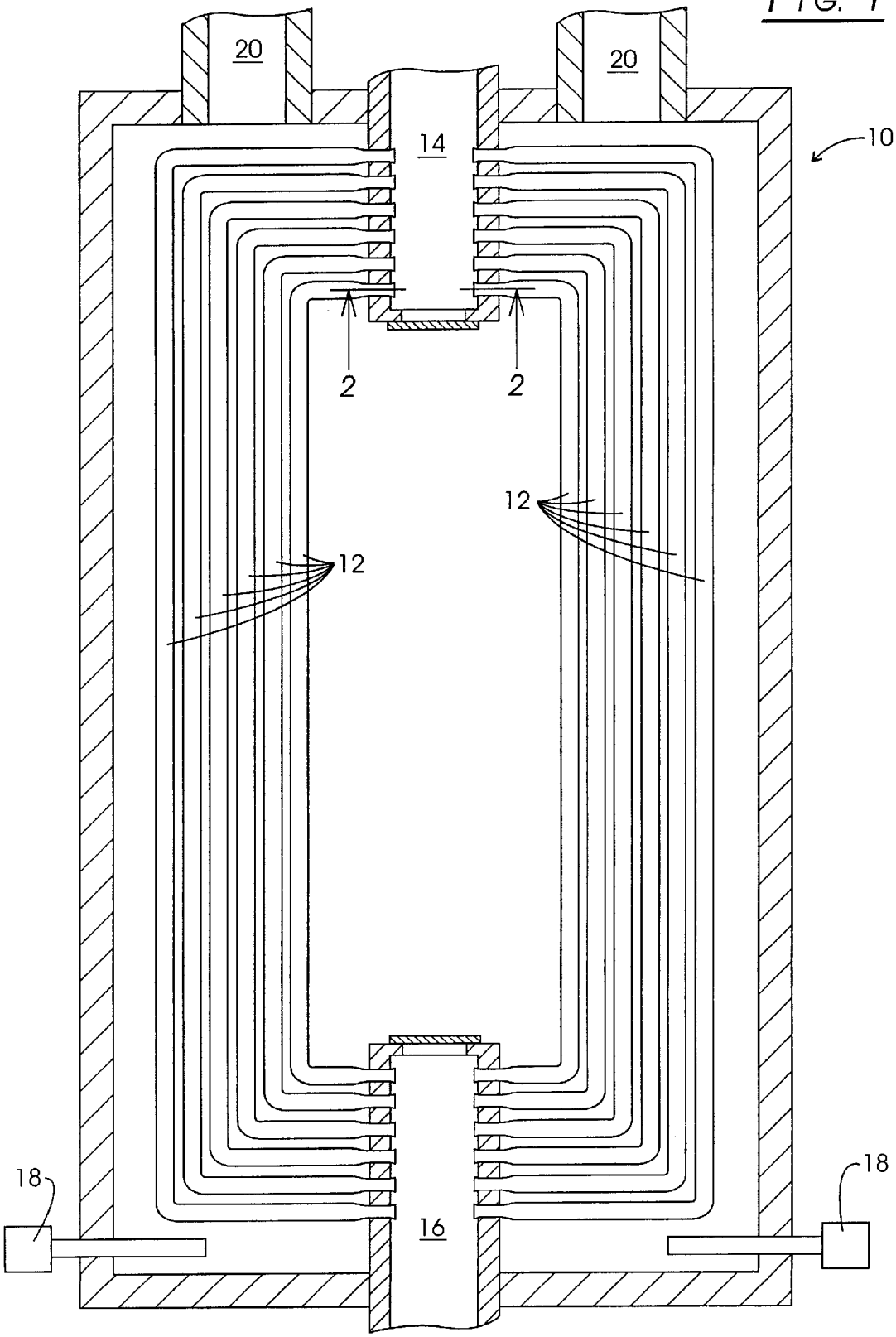
FIG. 1 is a schematic vertical section of a water-tube power boiler illustrating the environment in which the tool of the present invention is typically utilized.
Figure 2:
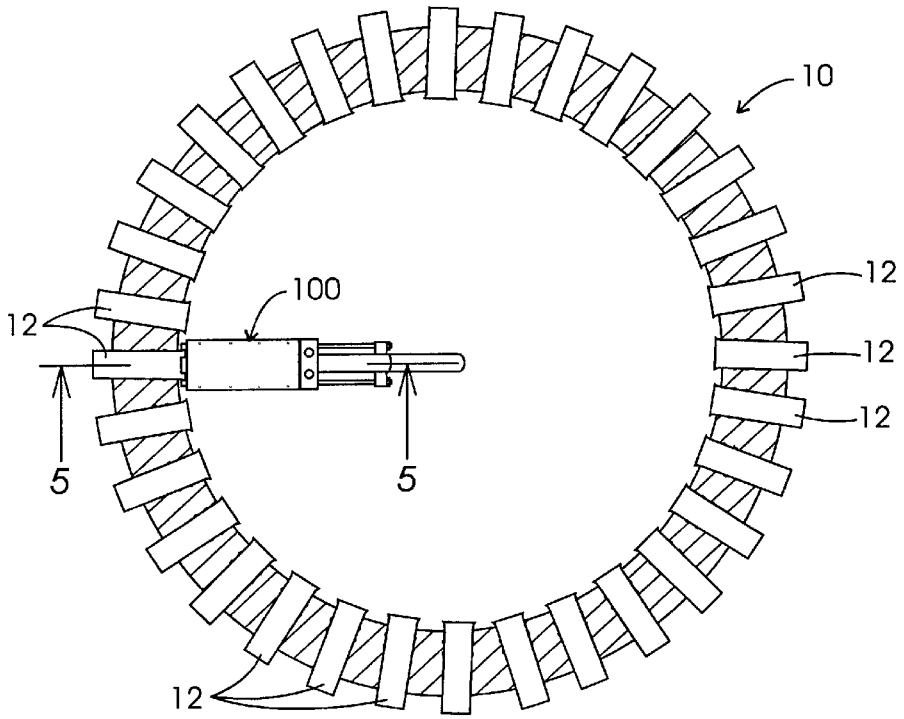
FIG. 2 is a section view taken at line 2—2 of FIG. 1.

DETAILED DESCRIPTION:

FIG. 1 schematically illustrates a power boiler 10 having multiple conventional boiler water-tubes 12 installed with their upper and lower flared ends co-operating with the walls of boiler steam and mud drums 14 and 16, respectively. Burners 18 are typically fired by a carbonaceous fuel, and the resulting effluent gasses of combustion, following heat extraction for water and steam heating purposes, are exhausted from within power boiler 10 through chimney connections 20. As with all power boilers, it is necessary from time to time to remove and replace one or more of individual boiler tubes 12 from within power boiler 10, and such is basically accomplished by selected tubes first being cut at their ends adjacent the exterior wall metal of drums 14 and 16 for removal. The boiler tube flared-end compression tool 100 of the present invention pertains generally to the removal of the tube flared-end segments that are initially retained in the steam and mud drum peripheral walls and, as illustrated in FIG. 2, such tool is basically utilized from a position within the applicable boiler drum.

Figure 3:
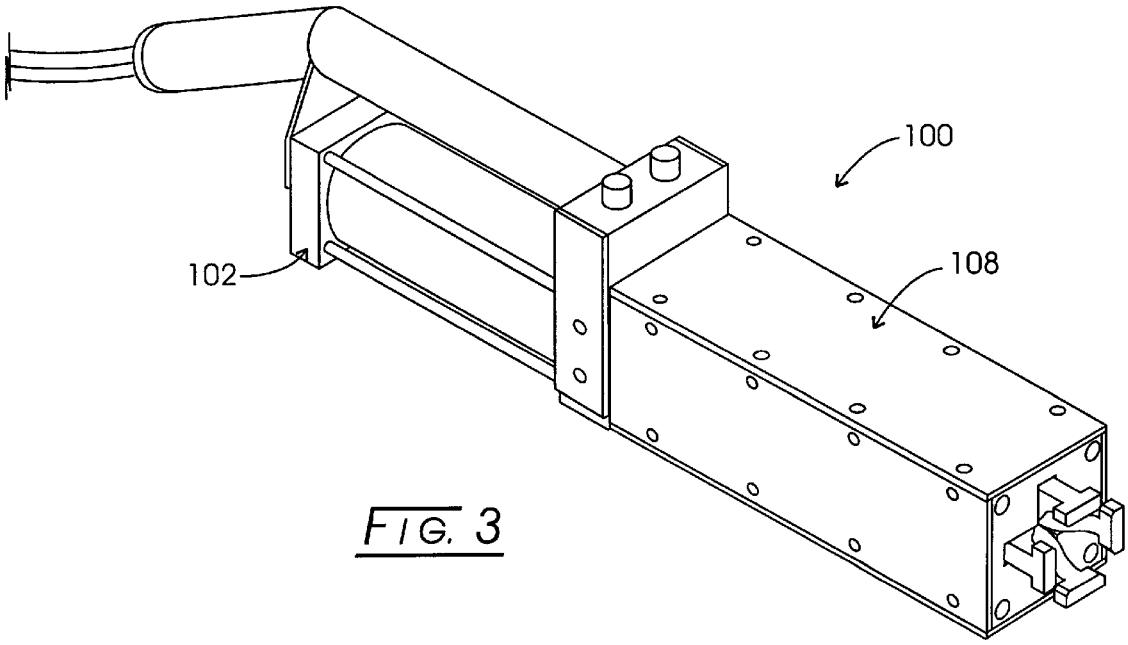
FIG. 3 is a perspective view of a preferred embodiment of the boiler tube flared end compression tool of the present invention.
Figure 4:
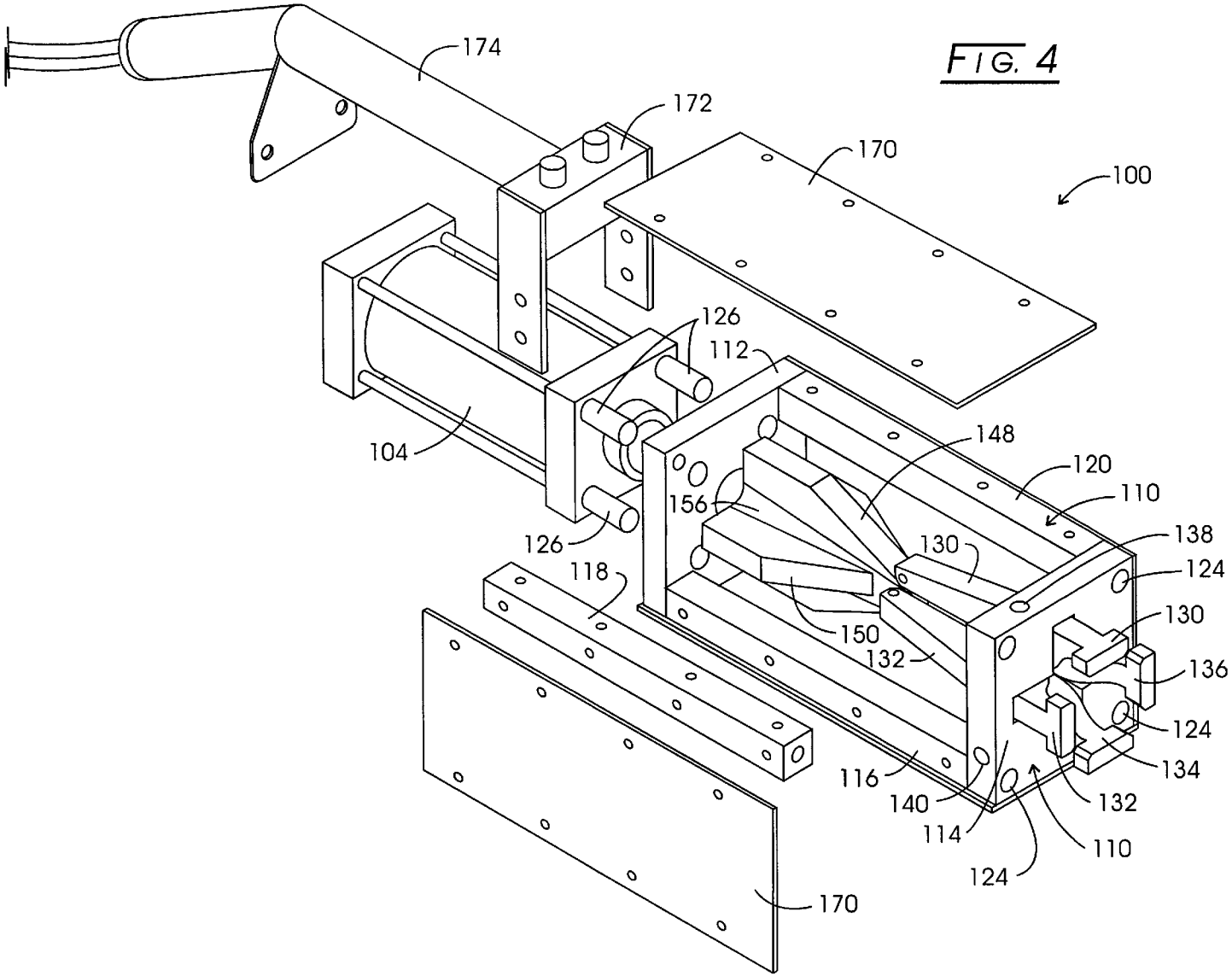
FIG. 4 is an exploded view of the boiler tube flared-end compression tool illustrated in FIG. 3.

FIGS. 3 and 4 best illustrate the basic construction details of a preferred embodiment of tool assembly 100. (Not shown in the drawings, however, is the conventional system for supplying the flow of pressurized fluid, which may be either pressurized hydraulic fluid or compressed air, to the conventional bi-directional pressure actuator subassembly 102 included with tool 100).

Figure 5:
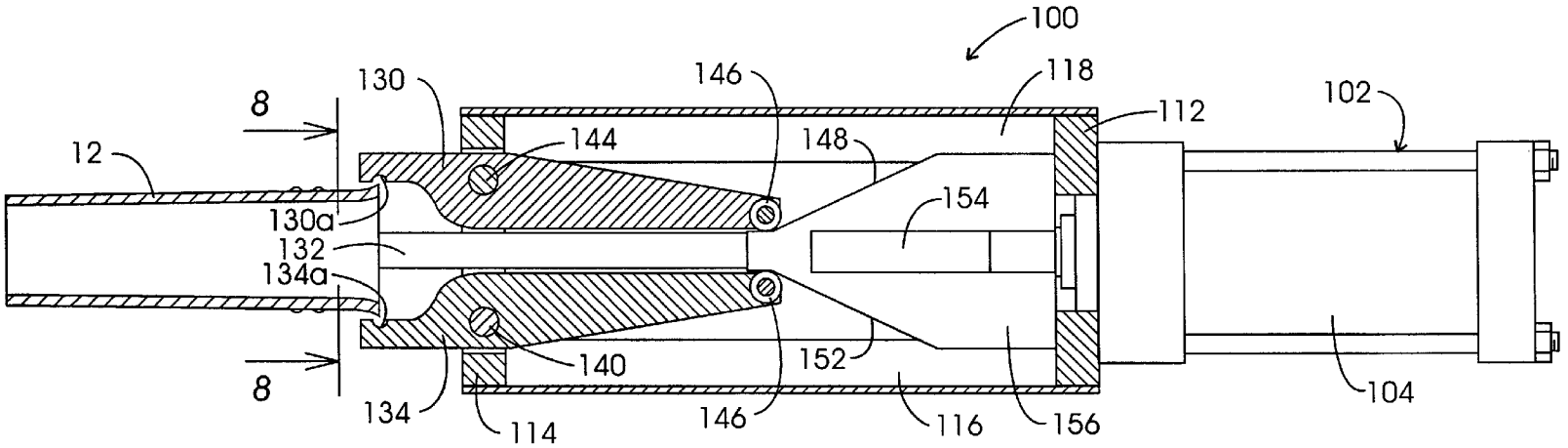
FIG. 5 is an elevation section view of the FIG. 3 tool co-operating with a gapped boiler tube flared-end segment taken at line 5—5 of FIG. 2 and in an initial operating condition.
Figure 6:
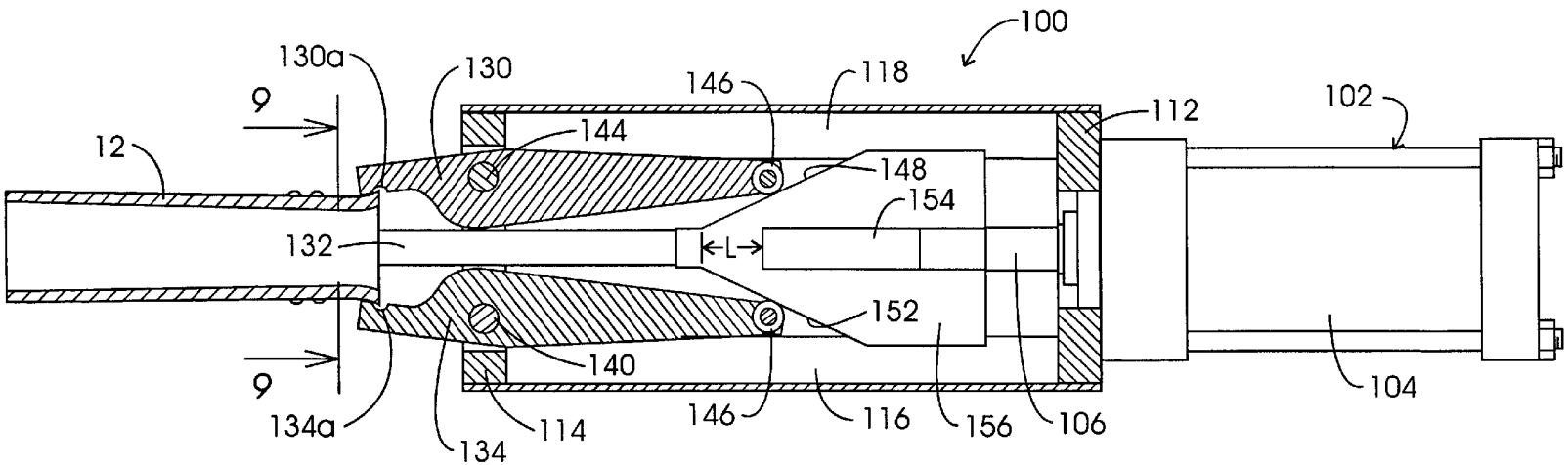
FIG. 6 is an elevation section view similar to FIG. 5 but illustrating the FIG. 3 tool after diametrical compression of the gapped boiler tube flared-end segment gap has been accomplished to an intermediate compression stage.
Figure 7:
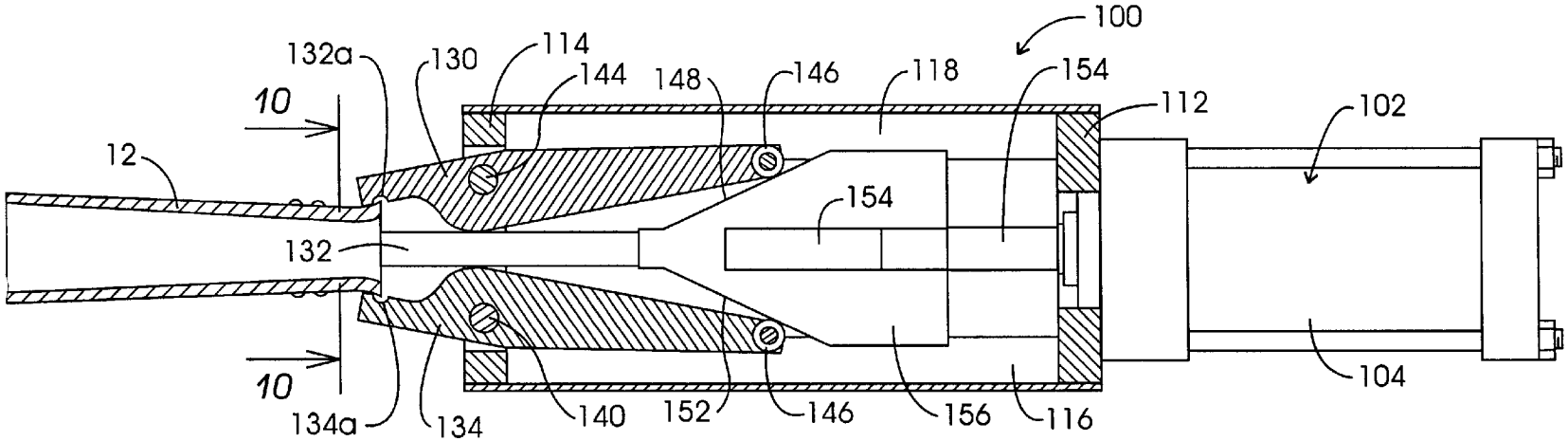
FIG. 7 is an elevation view similar to FIGS. 5 and 6 but illustrating the FIG. 3 tool after diametrical compression of the gapped boiler tube flared-end segment has been completed.

Tool assembly 100 includes, in addition to cylinder 104 and piston rod 106 of actuator subassembly 102, a tool head subassembly 108 that is fixedly secured to frame 110. Rigid frame element 110 is comprised of frame ends 112 and 114 connected to frame struts 116 through 122 by conventional threaded fasteners 124. Actuator subassembly 102 is rigidly secured to frame end 112 by conventional threaded fasteners 126. Also included in tool head subassembly 108 are rotatable compression jaw elements 130 through 136 which are pivotally mounted in frame end 114 by co-operating pivot pins 138 through 144, respectively. Each such jaw element has an operating arm of equal length with each jaw operating arm carrying a roller 146 which is at the operating arm free end and which engages a respective one of cam sloped surfaces 148 through 154 integral with tool head cam element 156. Cam element 156 is secured to actuator subassembly 102 and reciprocates interiorly of frame 110 when piston rod 106 is extended and retracted. Also, compression jaw elements 130 through 136 are provided with integral undercut reliefs 130*a* through 136*a*, respectively, and with concave inner face surfaces 130*b* through 136*b* to obtain a better gripping of boiler tube segment 12 during the tube compression operation. See FIGS. 5 through 7 for details regarding replacement of the different undercut reliefs and FIGS. 8 through 10 for positioning of the concave inner face surfaces. When compression jaw elements are rotated by the forces generated at cam element 156, each forward edge defining an undercut relief engages the exterior surface of tube end 12 and functions to draw the tube inwardly towards the tool head assembly 108 and not force it away from the tool head assembly 108.

It is important to note that in the FIGS. 3 through 10 embodiment of the present invention that sloped opposite cam surfaces 150 and 154 of cam member 156 are longitudinally offset by a distance "L" (see FIG. 6) relative to equally sloped opposite cam surfaces 148 and 152. As piston rod 106 is extended and cam element 156 is moved leftward (FIG. 4 to FIG. 5, and FIG. 5 to FIG. 6), the operating arms of jaw elements 130 and 134 are pivoted about their respective pivot pins 140 and 144 prior to the pivoting of the rotatable jaw operating arms of compression jaw elements 132 and 136. Such sequencing causes the outer end of co-operating boiler tube flared-end longitudinally gapped segment 12 to be sequentially "curled" in the manner illustrated by FIGS. 8 through 10. In its FIG. 10 condition, boiler tube flared-end segment 12 may then be more easily withdrawn from retention within the co-operating boiler drum wall than any withdrawal occurring in the FIG. 8 initial condition.

Figure 8:
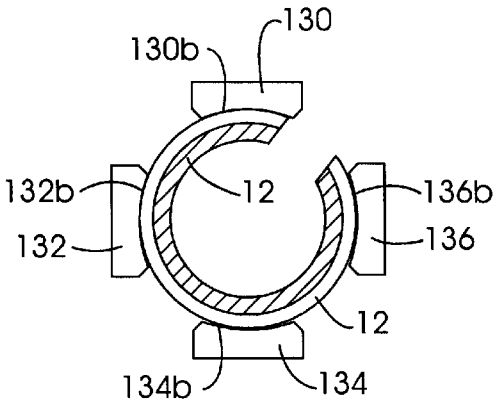
FIG. 8 is a section view taken at line 8—8 of FIG. 5.
Figure 9:
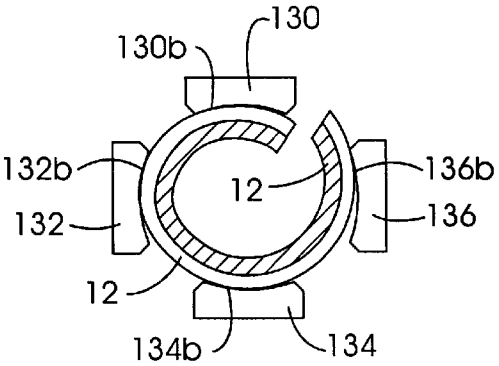
FIG. 9 is a section view taken at line 9—9 of FIG. 6.
Figure 10:
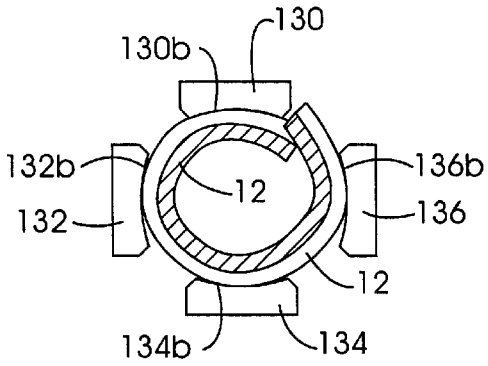
FIG. 10 is a section view taken at line 10—10 of FIG. 7.
Figure 11:
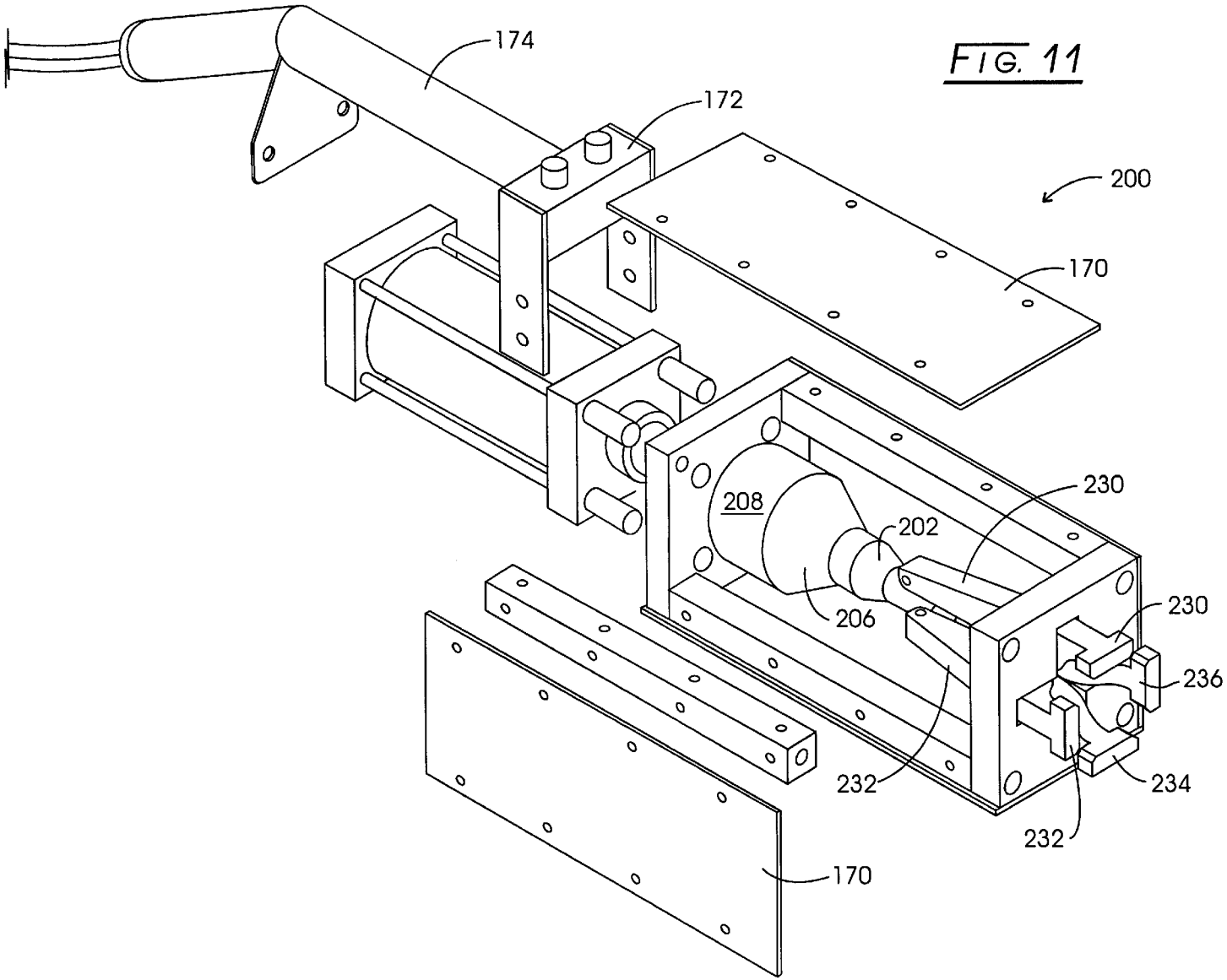
FIG. 11 is an exploded view of another embodiment of the boiler tube flared end compression tool of the present invention.

An alternate embodiment 200 of the present invention is illustrated in FIG. 11. Such differs from assembly embodiment 100 primarily with respect to the manner of developing sequential rotation of compression jaw elements 130 through 136. In the FIG. 11 embodiment the sequential annular cam surfaces 202 through 206 of cam element 208 co-operate first with the free ends of longer operating arms of compression jaw elements 230 and 234 and later with the free ends of shorter operating arms of compression jaw elements 232 and 236. Such tool head cam member and compression jaw arrangement accomplishes the same "curling" compression of a co-operating boiler tube flared-end longitudinally-gapped segment as is illustrated in FIGS. 8 through 10.

Figure 12:
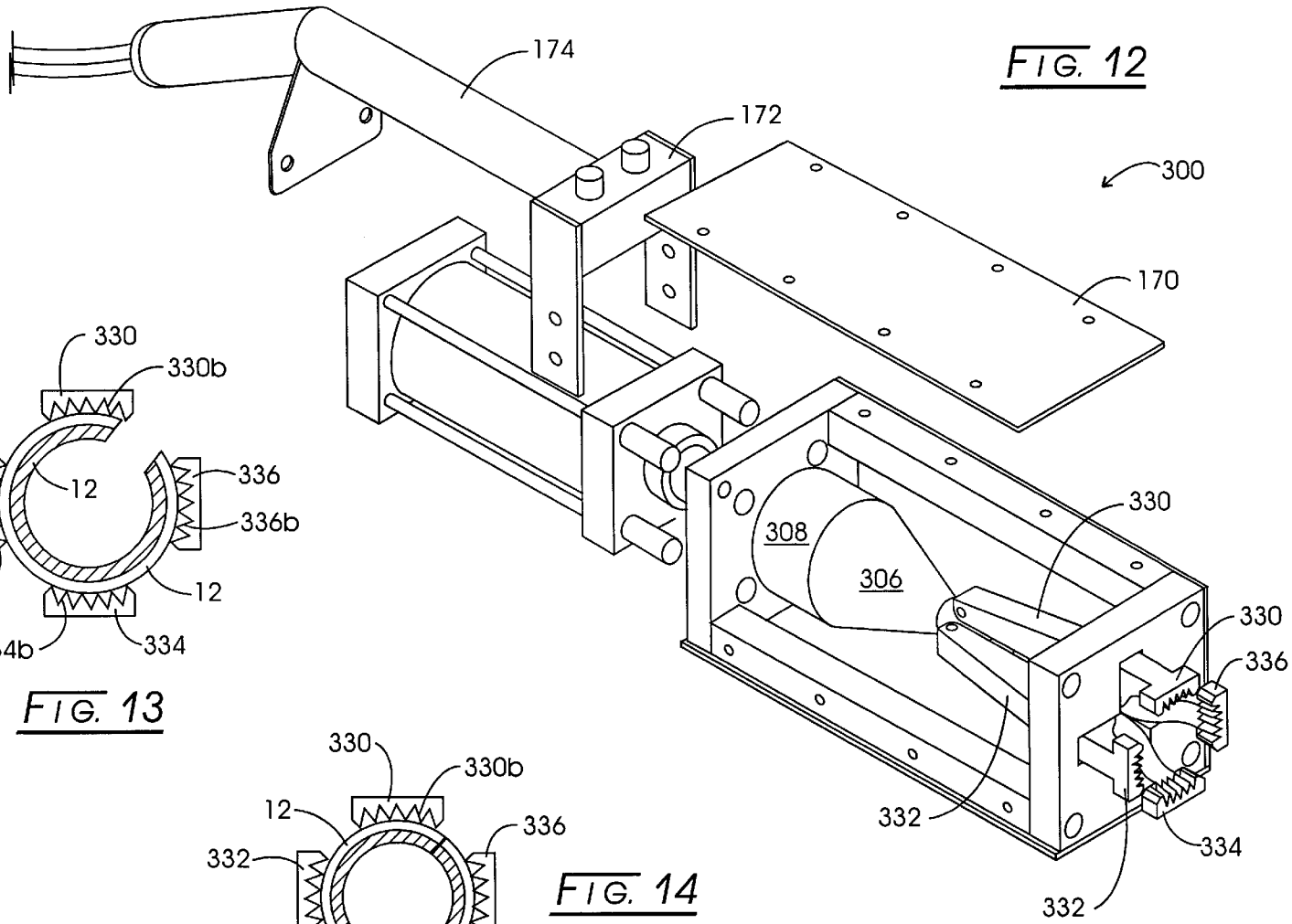
FIG. 12 is an exploded view of still another embodiment of the boiler tube flared-end compression tool of the present invention.
Figure 13:
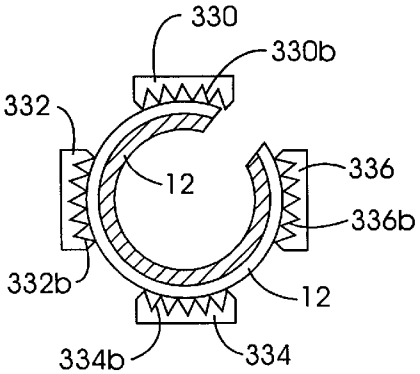
FIGS. 13 and 14 are section views similar to FIGS. 8 and 10 but relating to operation of the invention tool embodiment of FIG. 12.
Figure 14:
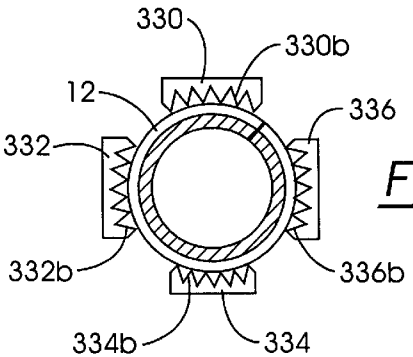

A further alternate embodiment 300 of the present invention is illustrated in FIG. 12. Such embodiment differs from assembly embodiments 100 and 200 primarily with respect to the manner of developing rotation of equal-length compression jaw elements 330 through 336. In the FIG. 12 embodiment such compression jaw elements are not rotated sequentially but instead simultaneously and at equal rotation rates. Accordingly, single annular cam surfaces 306 of cam element 308 uniformly acts upon the different assembly compression jaw elements. Such tool head cam member and compression jaw arrangement accomplishes a compression of a co-operating boiler tube flared-end longitudinally-gapped segment as illustrated in FIGS. 13 and 14. It should also be noted in FIGS. 12 through 14 that the different compression jaw elements 330 through 336 are each provided with an arcuate and longitudinally-serrated inner surface 330*b* through 336*b* to obtain a better gripping of the longitudinally-gapped boiler tube end-segment 12 during the compression operation.

As illustrated in FIGS. 4 and 11, the invention tool assemblies 100, 200, and 300 also include tool head cover elements 170, which are removably attached to frame member 110 by conventional threaded fasteners, a housing 172 for the power system direction control valve, and tool handle 174. Components 172 and 174 are preferably removably attached to and carried by actuator subassembly 102.

We claim, as our invention:

1. A compression tool assembly useful for removing a co-operating, longitudinally gapped, cylindrical wall boiler tube flared-end segment from retention within a power boiler drum wall, and comprising:

a rigid tool frame element;

a pressurized-fluid actuator subassembly supported by said rigid tool frame element and having an extendible and retractable piston rod;

two pairs of opposite and rotatable compression jaw elements pivotally carried by said rigid tool frame element, each said compression jaw element having a jaw operating arm; and a reciprocating cam element connected to said pressurized-fluid actuator for reciprocation in response to extension and retraction of said actuator subassembly piston rod, said cam element having two pairs of opposite sloped cam surfaces that respectively engage said two pairs of opposite and rotatable compression jaw element jaw operating arms, and that cause, in response to operation of said pressurized-fluid actuator subassembly, sequential rotation of said two pairs of opposite and rotatable compression jaw elements to thereby compress the wall of a co-operating, longitudinally gapped, boiler tube flared-end segment into an inwardly-curled cross-section configuration that facilitates boiler tube segment withdrawal from retention within the wall of a power boiler drum.

2. The compression tool assembly defined by claim 1, and wherein said two pairs of opposite and rotatable compression jaw elements have jaw operating arms of equal length, and wherein said cam element has one pair of opposite sloped cam surfaces that is longitudinally offset with respect to the other pair of said opposite sloped cam surfaces.

3. The compression tool assembly defined by claim 1, and wherein said two pairs of opposite and rotatable compression jaw elements have jaw operating arms of unequal length, and wherein said cam element has an annular sloped surface that engages said jaw operating arms of unequal length.

4. The compression tool assembly defined by claim 1, and wherein said two pairs of opposite and rotatable compression jaw elements have jaw operating arms of equal length, and wherein said cam element has one pair of opposite sloped cam surfaces having a steeper slope than the other pair of opposite sloped cam surfaces.

5. The compression tool assembly defined by claim 1, said compression jaw elements further comprising inner tube-gripping surfaces provided with transversely-concave configurations and with undercut reliefs whereby a co-operating boiler tube flared-end segment is drawn inwardly toward the tool assembly by the compression jaw element concave inner tube-gripping surfaces and adjacent undercut reliefs when said pressurized-fluid actuator subassembly is operated to circumferentially compress the co-operating boiler tube flared-end segment.

6. A compression tool assembly useful for removing a co-operating, longitudinally gapped, cylindrical wall boiler tube flared-end segment from retention within a power boiler drum wall, and comprising:

a rigid tool frame element;

a pressurized-fluid actuator subassembly supported by said rigid tool frame element and having an extendible and retractable piston rod;

two pairs of opposite and rotatable compression jaw elements pivotally carried by said rigid tool frame element, each said compression jaw element having a jaw operating arm; and a reciprocating cam element connected to said pressurized-fluid actuator for reciprocation in response to extension and retraction of said actuator subassembly piston rod, said cam element having a frustroconical cam surface that co-operates with said two pairs of opposite and rotatable compression jaw elements to cause said jaw elements to be rotated simultaneously and at equal rotational rates to thereby compress the wall of a co-operating, longitudinally gapped, boiler tube flared-end segment into a reduced-diameter cross-section configuration that facilitates boiler tube segment withdrawal from retention within the wall of a power boiler drum.

7. The compression tool assembly defined by claim 6, said compression jaw elements further comprising inner tube-gripping surfaces provided with concave cross-section configurations and with undercut reliefs whereby a co-operating boiler tube flared-end segment is drawn inwardly toward the tool assembly by the compression jaw element concave inner tube-gripping surfaces and adjacent undercut reliefs when said pressurized-fluid actuator subassembly is operated to circumferentially compress the co-operating boiler tube flared-end segment.

8. The compression tool assembly defined by claim 7, and wherein said compression jaw element concave inner tube-gripping surfaces have concave cross-section configurations that are serrated longitudinally.

* * * * *